United States Patent [19]

Ohtani et al.

[11] Patent Number: 4,789,613

[45] Date of Patent: Dec. 6, 1988

[54] ELECTROSTATIC IMAGE DEVELOPING TONER WITH HIGH DIELECTRIC MATERIAL

[75] Inventors: Shoji Ohtani, Osaka; Kazunari Takemura, Wakayama; Yukiya Sato, Wakayama; Rikio Tsushima, Wakayama, all of Japan

[73] Assignee: Kao Corporation, Tokyo, Japan

[21] Appl. No.: 70,699

[22] Filed: Jul. 7, 1987

[30] Foreign Application Priority Data

Jul. 9, 1986 [JP] Japan ..... 61-161199

[51] Int. Cl.[4] ..... G03G 9/08

[52] U.S. Cl. ..... 430/110; 430/137

[58] Field of Search ..... 430/110, 137

[56] References Cited

U.S. PATENT DOCUMENTS 3,779,926 12/1973 Merck et al. ..... 430/110 X
4,051,077 9/1977 Fisher ..... 430/110
4,507,378 3/1985 Wada et al. ..... 430/137

FOREIGN PATENT DOCUMENTS 59-57252 4/1984 Japan ..... 430/137
61-110157 5/1986 Japan ..... 430/110

OTHER PUBLICATIONS

Strella, "Composite Lubricants and Overcoats for Blade Cleaning Systems", Xerox Discl. Jour., vol. 2, No. 4, Jul./Aug. 1977, p. 55.

*Primary Examiner*—Roland E. Martin
*Attorney, Agent, or Firm*—Birch, Stewart, Kolasch & Birch

[57] ABSTRACT

A developing toner composition is effectively prepared by dispersing in a polymerizable monomer a charge controller, a coloring agent and a highly dielectric material having a dielectric constant of at least 10 at room temperature and a volume resistivity of at least $1\times10^{10}$ ohm.cm and dispersion-polymerizing the resulting dispersion in an aqueous medium in the presence of a dispersion stabilizer to obtain resin particles.

20 Claims, No Drawings

ELECTROSTATIC IMAGE DEVELOPING TONER WITH HIGH DIELECTRIC MATERIAL

This invention relates to a dry toner, and its production method, for developing an electrostatically charged image in electrophotography, electrostatic recording or electrostatic printing.

Developing methods using a dry toner which consists of a coloring agent and a resin include the following methods:

(1) A method using a two-component developer which comprises mixing the dry toner with a carrier having a greater particle size than that of the toner to impart a charge of a polarity opposite to that of an electrostatic latent image to the toner by frictional charge and bringing a developer comprising a mixture of the toner and the carrier into contact with the electrostatic latent image to develop it.

(2) A method using a one-component developer wherein a toner containing a magnetic substance is brought into contact with, or close to, an electrostatic latent image for developing.

Conventional methods of obtaining these toners involve the steps of melting a thermoplastic resin, adding thereto a coloring agent such as a dye or a pigment and, if necessary, a magnetic substance, a frictional charge controller, an offset inhibiter, a lubricant, and the like, mixing the resulting mixture sufficiently, cooling and solidifying the mixture, pulverizing it and classifying the resulting particles to obtain a toner having a desired particle size.

However, the conventional methods described above are not free from the following various drawbacks. First of all, various types of apparatus to be used in the various production steps, such as a polymerizer for producing the resin, a kneader, a pulverizer, a classifier, and the like, are necessary. Since the number of production steps and energy consumption are great, the production cost increases. Second, it is difficult to obtain a uniform mixture in the mixing and kneading step, and a delicate condition is particularly necessary for dispersing the mixture uniformly. Third, the pulverizing step does not always provide a toner having an appropriate particle size which is suitable for obtaining a clear image without any fogging, but also produces finer and coarser particles as a by-product, so that they must be classified and removed. Thus, the step is complicated and the yield of particles having the desired sizes is low, thereby increasing the production cost. Fourth, the resulting powder has indefinite shapes because of pulverization, and a poor fluidity of the powder and formation of fine powders due to stirring in conducting frictional charging will result in the fogging of the image.

Japanese Patent Publication Nos. 10231/1961, 518305/1972 and 14895/1976 disclose a production method of toners by suspension polymerization. This method eliminates the necessity of pulverization, simplifies the production process and improves the drawbacks described above.

However, the toner obtained by this method has high humidity dependence, low moisture-proofness and chargeability and cannot provide a satisfactory image at high humidity. These problems result from a dispersion stabilizer that is indispensable in the suspension polymerization process for dispersing a monomer stably in a dispersion medium and for preventing coagulation and covers the surface of the resulting polymer particles.

More precisely, the dispersion stabilization methods in the suspension polymerization method can be classified broadly into the following two groups. A first method comprises dissolving a water-soluble polymer in a dispersion medium and, according to this method, a sufficiently high dispersion stabilization effect can be obtained relatively easily. However, the water-soluble polymer is adsorbed or grafted stiffly to the particle surface of the resulting polymer composition and cannot be removed completely after polymerization even when water washing is repeated.

A second method comprises dispersing in a dispersion medium an inorganic material which is hardly soluble in water. However, dispersion stabilization in this method is delicately affected by a monomer composition and a polymerization condition and cannot be attained sufficiently by a small amount of the hardly water-soluble inorganic material. Even if the polymer particles can be obtained satisfactorily by this method, a large amount of the inorganic material being hardly water-soluble must be removed and it is extremely difficult to remove it completely. Therefore, the inorganic material will remain to some extent in the polymer particles even when acid treatment and water washing are repeated.

In the meantime, the electric characteristics of a toner for use in dry electrophotography or electrostatic recording depend mostly on the toner surface. When the water-soluble polymer or the hardly water-soluble inorganic material therefore remains on the surface of the polymer particles as described above, the physical properties of the water-soluble polymer, such as the electric conductivity and the dependency on humidity, directly affect the electric characteristics of the toner and make frictional chargeability of the toner extremely unstable.

If the toner as described above is used as such in the electrophotographic process, the image will be distorted when developed at high humidity because the quantity of frictional charge of the toner drops remarkably and scattering of the toner and fogging of the image will occur. Because conductivity is high on the toner surface, even if the image has been developed on a photosensitive member and the toner has attached to it, it becomes extremely difficult for this toner to retain the charge until the image is transferred to paper or the like in a subsequent transfer step. As a result, the image is distorted more and more in the transfer step and the transfer efficiency drops remarkably.

To solve this problem, a method has been proposed (in Japanese Patent Laid-Open No. 17736/1978) wherein the surface of the resulting toner particles is treated with a silane coupling agent to make it hydrophobic. However, such a surface treatment of the toner deteriorates the original charge characteristics of the binder resin and the charge controller, and the desired charge quantity cannot be obtained due to variance of the surface treatment condition. In practice, the toner obtained by such a silane coupling treatment exhibits some improvements in moisture-proofness but the charge quantity drops at high humidity and any satisfactory image cannot be stably obtained.

It is therefore an object of the present invention to provide an electrostatically charged image-developing toner which maintains its properties even in a high moisture environment and maintains a stable image even at high humidity.

It is another object of the present invention to provide an electrostatically charged image developing toner which has an excellent frictional chargeability, and moreover, has an excellent charge retaining property.

It is still another object of the present invention to provide an electrostatically charged image developing toner, and production method thereof, which improves the drawbacks inherent in the suspension polymerization method described above.

As a result of intensive studies to improve the problems of the prior art described above, the inventors of the present invention found out that a toner having excellent moisture-proofness, chargeability and charge retaining property can be obtained by dispersing a highly dielectric material having a dielectric constant of at least 10 at normal temperature and volume resistivity of at least $1\times10^{10}$ ohm.cm in a polymerizable monomer together with a charge controller and a coloring agent and then suspension-polymerizing the highly dielectric material in an aqueous medium in the presence of a suspension/dispersion stabilizer. The present invention is thus completed.

A toner composition of the invention is useful to develop an electrostatically charged image and comprises a resin binder and a coloring agent, said resin binder comprising a polymer, a charge controller and a highly dielectric material having a dielectric constant of at least 10, preferably 100, at room temperature, in particular at 25° C., and a volume resistivity of at least $1\times10^{10}$ ohm.cm.

The toner composition is preferred to comprise 0.3 to 50 wt. %, based on the polymer, of the highly dielectric material.

The highly dielectric material preferably includes a titanate, a niobate, a tartrate, a zirconate and a stannate. A metal salt of the substance is especially preferred.

The invention moreover provides a process for preparing a developing toner composition for an electrostatically charaged image, which comprises dispersing in a polymerizable monomer a charge controller, a coloring agent and a highly dielectric material having a dielectric constant of at least 10 at the room temperature and a volume resistivity of at least $1\times10^{10}$ ohm.cm and dispersion-polymerizing the resulting dispersion in an aqueous medium in the presence of a dispersion stabilizer to obtain resin particles.

In the process, the dispersion is preferred to contain 0.3 to 50 wt. %, based on the monomer, of the highly dielectric material.

According to the findings of the present inventors, a highly dielectric material, when contained in the toner in the present invention, plays the role of a so-called "capacitor" to promote the frictional charge of the toner surface and is helpful to stably retain the charge on the toner surface once it is charged. The effect found out by the present inventors lasts at a high humidity and remarkably prevents the leak of the charge even if some conductive suspension dispersant remains on the toner surface. Therefore, excellent developability and transferability can be obtained and a toner which does not cause any drop of the image quality can be obtained.

The toner of the present invention can be produced by mixing and dispersing the highly dielectric material together with a coloring agent such as carbon black, a charge controller and other necessary agents for improving the toner characteristics in a polymerizable monomer to prepare the oily phase and then polymerizing the mixture by suspension polymerization to obtain polymer particles.

According to one example of the suspension polymerization methods, a dispersion stabilizer such as a water-soluble polymer or a hardly water-soluble inorganic material is uniformly dispersed or dissolved in an aqueous phase, and the liquid dispersion of the oily phase described above is then added to the aqueous phase and dispersed in oil droplets of from 5 to 30 μm by dispersion means such as a homomixer, a homogenizer, or the like. The weight ratio of the oily phase to the aqueous phase is from 1:1 to 1:10 provided that no cohesion of particles occur in the polymer. The dispersion containing the oily phase that is uniformly dispersed in the aqueous phase is transferred to a polymerization vessel equipped with a stirrer, a condensor, a thermometer, a nitrogen inlet tube, and the like, and while the temperature is raised to a point (50° to 90° C.) at which a polymerization initiator is decomposed, polymerization is carried out in a nitrogen atmosphere.

After polymerization is completed, the aqueous phase is removed by filtration and washed with water or treated with an acid, whenever necessary.

Examples of the highly dielectric material to be used in the present invention include barium titanate, magnesium titanate, strontium titanate, zirconium titanate, lead titanate, lithium titanate, potassium titanate, bismuth titanate, calcium titanate, yttrium titanate, lithium niobate, potassium niobate, lithium tantalate, lead zirconate, barium zirconate, barium stannate and their solid solutions, sodium tartrate, potassium dihydrogenphosphate, thiourea, and sodium nitrate. Among them, preferred are those which contain the titanate. Since sodium tartrate, potassium dihydrogenphosphate, thiourea and sodium nitrate are water-soluble, they are not preferred in suspension polymerization.

In the present invention, the highly dielectric material is used in fine powder from having a particle size of below 3 μm and preferably below 1 μm. At times, pulverization means such as a ball mill or a sand mill may be used.

Though the fine powder can be used without any surface treatment, a fine powder whose surface is made hydrophobic is preferably used in order to prevent migration to the aqueous phase during suspension polymerization. It is possible to use ordinary agents for making the surface hydrophobic, such as a silane coupling agent, a titanium coupling agent, alkali metal salts of long-chain fatty acids, and the like.

In the present invention, the amount of addition of the highly dielectric material is ordinarily from 0.3 to 50 wt % based on the polymerizable monomer and preferably from 0.5 to 30 wt %. If the amount is below 0.3 wt. %, the effect cannot be obtained. Then if it is above 50 wt %, suspension stability will drop during polymerization.

Known charge controllers, whether they may be of a positive type or a negative type, can be used in the present invention, and the amount is in the ordinary range. When a charge controller of a negative type, such as an azo complex dye is used, for example, a negatively chargeable toner is obtained and when a positive type of charge controller such as Nigrosine is used, on the other hand, a positively chargeable toner is obtained. In this manner, the positive and negative charge controllers can be selected according to the purpose.

The monomer having 3 to 25 carbon atoms may be used in the present invention. The monomer, for example, include styrene, p-chlorostyrene, p-methylstyrene, vinyl acetate, vinyl propionate, vinyl benzoate, methyl acrylate, ethyl acrylate, n-butyl acrylate, iso-butyl acrylate, dodecyl acrylate, n-octyl acrylate, methyl methacrylate, ethyl methacrylate, n-butyl methacrylate, iso-butyl methacrylate, diethyleaminoethyl methacrylate, t-butylaminomethyl methacrylate, acrylonitrile, 2-vinylpyridine and 4-vinylpyridine. They may be used either alone or as a mixture of them.

In the present invention, a toner having higher durability can be produced by adding a polyfunctional monomer such as divinylbenzene, ethylene glycol dimethacrylate, trimethylolpropane triacrylate, glycidyl methacrylate or glycidyl acrylate as a crosslinking agent. The amount of the polyfunctional monomer is from 0.05 to 20 wt % based on the monomer and preferably from 0.5 to 5 wt %.

Ordinary oil-soluble peroxide or azo initiators can be used as the polymerization initiator in the present invention. Examples of the initiators include benzoyl peroxide, lauroyl peroxide, 2,2'-azobisisobutyronitrile, 2,2'-azobis(2,4-dimethylvaleronitrile), o-chlorobenzoyl peroxide, and o-methoxybenzoyl peroxide. The amount of the initiator is from 0.1 to 10 wt % based on the polymerizable monomer and preferably from 0.5 to 5 wt %.

The dispersion stabilizer to be used in the present invention is either water-soluble polymer compounds such as gelatin, starch, hydroxyethylcellulose, carboxymethylcellulose, polyvinylpyrrolidone, polyvinyl alkyl ethers, polyvinyl alcohol and the like, or hardly water-soluble inorganic compounds such as barium sulfate, calcium sulfate, barium carbonate, calcium carbonate, magnesium carbonate, calcium phosphate, and the like. The amount of the dispersion stabilizer is from 0.1 to 5 wt % based on water and preferably from 0.5 to 2 wt %.

The toner in accordance with the present invention may contain an olefinic polymer having a low molecular weight that is known as a so-called parting agent in order to prevent offset and to improve fluidity and fixability.

The low-molecular weight olefinic polymer is preferably contained during polymerization of the monomer together with the coloring agent.

Examples of the low-molecular weight olefinic polymer to be used in the toner of the present invention include polyethylene, polypropylene, ethylene-vinyl acetate copolymer, chlorinated polyethylene wax, polyamide, polyester, polyurethane, polyvinyl butyral, butadiene rubber, phenolic resin, epoxy resin, rosin-modified resin, silicone oil, and silicone wax.

The amount of the low-molecular weight olefinic polymer is from 1 to 20 parts by weight per 100 parts by weight of the resin component of the toner, and preferably from 3 to 15 parts by weight. If the amount is below 1 part by weight, any sufficient offset prevention effect may not be obtained and if it is above 20 parts by weight, on the other hand, the polymer may get gelled during polymerization.

An image can be formed using the toner of the present invention in accordance with an electrophotographic process, for example, by using a selenium photosensitive member or a photosensitive member formed by applying a photosensitive member, prepared by dispersing an inorganic photoconductive material such as zinc oxide, cadmium sulfide, cadmium selenide, cadmium sulfoselenide, lead oxide, mercury sulfide or the like in a binder resin, on a electroconductive support, or a photosensitive member prepared by dispersing an organic photoconductive material such as anthracene or polyvinylcarbazole in a binder resin, whenever necessary, on an electroconductive support. The whole surface of the photosensitive layer of the photosensitive member is then charged by corona discharge using a corotron charger or a scorotron charger, and subjected to an imagewise exposure with light to form an electrostatically charged image. The formed image is next developed by a cascade method or a magnetic brush method with a developer comprising a mixture of the toner of the present invention and glass balls or iron powder carrier, for example, to form a toner image. This toner image is pressed against a transfer paper under corona discharge. The toner image thus transferred on the transfer paper is heated and fixed with a hot-roller fixing device coated with a fluororesin or silicone rubber having mold releasability.

Effect of the Invention

As described above in detail, the electrostatically charged image developing toner in accordance with the present invention is prepared by mixing and dispersing a specific highly dielectric material, a coloring agent, a charge controller and other necessary agents for improving the toner characteristics in a monomer and suspension-polymerizing the suspension to obtain polymer particles. In this manner the inventors of the present invention have made it possible for the first time to remarkably improve the low moisture-proofness, low frictional chargeability and low charge retaining property of those toners, which are obtained ordinarily by suspension polymerization, due to the remaining dispersion stabilizer on the toner surface. The inventors have also produced a toner having excellent developability and high transferability not only in an ordinary environmental condition but also at high humidity while making the most of the advantage of the suspension polymerization method in that it can easily provide the toner.

EXAMPLE

Some preferred embodiments of the present invention will now be described, though they are not particularly limitative but are only for the purpose of illustration. In the embodiments which follow, all parts are by weight.

EXAMPLE 1

A mixture consisting of 50 parts of fine powder of barium titanate having a particle size of up to 1 μm, 500 parts of toluene and 3 parts of isopropyl triisostearoyl titanate ("Pren Act TTS", a product of Ajinomoto) was stirred at 80° C. for 3 hours, filtered and dried under a reduced pressure to obtain 45 parts of fine powder of barium titanate that was made hydrophobic.

A mixture consisting of 5 parts of this hydrophobic barium titanate fine powder, 15 parts of n-butyl acrylate, 6 parts of carbon black "#44", a product of Mitsubishi Chemical Industries, Ltd.), 2 parts of low-molecular weight polyethylene ("Mitsui Hiwax 210P", a product of Mitsui Petrochemical Industries, Ltd.) and 1.5 parts of a charge controller ("Aizenspiron Black TRH", a product of Hodogaya Chemical Co., Ltd.) was dispersed for 5 hours using a ball mill. After 1 part of 2,2'-azobisisobutyronitrile was dissolved in this dispersion, the dispersion was added to 250 parts of a 1% aqueous solution of polyvinyl alcohol ("Gosenol GL-05", a product of Nippon Goseikagaku Kogyo K.K.) and stirred for 3 minutes at 6,000 rpm using a TK homomixer (a product of Tokushu Kikakogyo K.K.).

This suspension was subjected to a polymerization reaction at 75° C. for 8 hours in a separable flask in a nitrogen atmosphere at a stirring speed of 100 rpm using an ordinary stirrer. After the polymerization was completed, the reaction product was centrifuged, washed with water and dried over a night at 40° C. in a vacuum dryer. There was thus obtained a toner having a mean particle size of 11 μm.

A developer was prepared by adding 96 parts of carrier iron powder ("CM-100", a product of D. M. Stuart) to 4 parts of this toner, and its charge quantity was measured under a medium-humidity condition (60% RH, 20° C.) with a blowoff powder charge measuring instrument. It was found to be −14.9 μc/g. When an image was formed by a Ricoh FT4060, a clear image devoid of any fogging could be obtained. Even after 10,000 copies were produced, the charge quantity did not drop and the occurrence of any fogging could be observed, either, and a picture having a high quality equivalent to the initial quality could be obtained. The transfer efficiency was as high as 87%.

When the charge quantity was measured at high humidity (85% RH, 35° C.), it was found to be −14.6 μc/g. A clear image without any fogging could be obtained at high humidity, and any problems such as a non-uniform image density did not occur.

As described above, any change could hardly be observed in the charge quantity and the image at a medium or high humidity.

EXAMPLE 2

Suspension polymerization was carried out to obtain toner particles in the same way as in Example 1 except that barium titanate in Example 1 was replaced by strontium titanate fine powder having a particle size of up to 1 μm.

A developer was prepared by use of this toner in the same way as in Example 1, and the measurement of the charge quantity as well as image formation were carried out under medium- and high-humidity conditions. The charge quantity was found to be −13.8 μs/g and −12.5 μc/g under the medium- and high-humidity conditions, respectively. In either case, the resulting image was clear and devoid of any fogging, and a drop of image quality during cotinuous reproduction and abnormal image density at high humidity could not be observed.

EXAMPLE 3

Suspension polymerization was carried out to obtain toner particles in the same way as in Example 1 except that barium titanate was replaced by lead titanate fine powder.

When a developer was prepared using this toner in the same way as in Example 1 and its charge quantity was measured, it was found to be −17.5 μc/g at medium humidity and −16.7 μc/g at high humidity. In either case, the resulting image was clear and devoid of any fogging.

EXAMPLE 4

Suspension polymerization was carried out to obtain toner particles in the same way as in Example 1 except that barium titanate was replaced by the fine powder of a solid solution of barium titanate and barium stannate (85/15 molar ratio).

When a developer was prepared using this toner in the same way as in Example 1 and its charge quantity was measured, it was found to be −16.5 μc/g at medium humidity and −16.0 μc/g at high humidity. In either case the resulting image was clear and devoid of any fogging.

EXAMPLE 5

Suspension polymerization was carried out to obtain toner particles in the same way as in Example 1 except that barium titanate was replaced by a fine powder of a solid solution of barium titanate and barium zirconate.

When a developer was prepared using this toner in the same way as in Example 1 and its charge quantity was measured, it was found to be −14.7 μc/g at medium humidity and −14.1 μc/g at high humidity. In either case, the resulting image was clear and devoid of any fogging.

COMPARATIVE EXAMPLE 1

Suspension polymerization was carried out to obtain toner particles in the same way as in Example 1 except that no barium titanate was added.

A developer was prepared by adding 96 parts of carrier iron powder ("CM-100", a product of D. M. Stuart) to 4 parts of this toner and the charge quantity of the resulting developer was measured under a medium-humidity condition (60% RH, 20° C.) using a blowoff powder charge quantity measuring instrument. It was found to be −17.8 μc/g. When the image was formed by a Ricoh FT4060 using this developer, a clear picture devoid of any fogging could be obtained. However, a drop of charge quantity started after reproduction of about 4,000 copies and the occurrence of fogging and the drop of the image quality could be observed after 5,000 to 6,000 copies. The transfer efficiency was as low as 65%.

When the charge quantity was measured in the same way under a high-humidity condition (85% RH, 35° C.), it was found to be −3.2 μc/g so that charging could hardly occur. Though an image was formed in this state, the scattering of the toner was so vigorous and the image density dropped so extremely that the image itself was only ambiguous (e.g. the image was not clear).

What is claimed is:

1. A developing toner composition for an electrostatically charged image, which comprises (i) a coloring agent, and (ii) a resin binder comprising a polymer, a charge controller and an effective amount of a highly dielectric material for maintaining suspension stability which is selected from the group consisting of a titanate, a niobate, a tartrate, a zirconate, a stannate, potassium dihydrogen phosphate and sodium nitrate, wherein said highly dielectric material has a dielectric constant of at least 10 at room temperature and a volume resistivity of at least $1\times10^{10}$ ohm.cm, said toner composition having a surface substantially free of said dielectric material.

2. The toner composition as claimed in claim 1, which comprises 0.3 to 50 wt. % of the highly dielectric material.

3. The toner composition as claimed in claims 1 or 2, which has been obtained by dispersing in a polymerizing monomer a charge controller, a coloring agent and a highly dielectric material having a dielectric constant of at least 10 at the room temperature and a volume resistivity of at least $1\times10^{10}$ ohm.cm and dispersion-polymerizing the resulting dispersion in an aqueous medium in the presence of a dispersion stabilizer to obtain resin particles.

4. A process for preparing a developing toner composition for an electrostatically charged image, which comprises:

(i) dispersing in a polymerizable monomer a charge controller, a coloring agent and an effective amount of a highly dielectric material for maintaining suspension stability during polymerization which is selected from the group consisting of a titanate, a noibate, a tartrate, a zicronate and a stannate, wherein said highly dielectric material having a dielectric constant of at least 10 at room temperature and having a volume resistivity of at least $1\times10^{10}$ ohm.cm, and (ii) dispersion-polymerizing the resulting dispersion in an aqueous medium in the presence of a dispersion stabilizer to obtain resin particles.

5. The process as claimed in claim 4, wherein said dispersion contains 0.3 to 50 wt %, based on the monomer, of the highly dielectric material.

6. A developing toner composition for an electrostatically charged image, which comprises:

(i) a coloring agent, and (ii) resin binder comprising a polymer, a charge controller and an effective amount of a highly dielectric material for maintaining suspension stability during polymerization which is selected from the group consisting of a titanate, a niobate, a tartrate, a zirconate and a stannate, wherein said highly dielectric material has a dielectric constant of at least 10 at room temperature and a volume resistivity of at least $1\times10^{10}$ ohm.cm, said devleoping toner composition being prepared by the steps which comprise:

(a) dispersing in a polymerizing monomer a charge controller, said coloring agent and said highly dielectric material having a dielectric constant of at least 10 at room temperature and having a volume resistivity of at least $1\times10^{10}$ ohm.cm, and (b) dispersion-polymerizing the resulting dispersion in an aqueous medium in the presence of a dispersion stabilizer to obtain resin particles.

7. The toner composition as claimed in claim 1, wherein said highly dielectric material is a metal salt.

8. The toner composition as claimed in claim 1, wherein said coloring agent is carbon black.

9. The toner composition as claimed in claim 1, wherein the highly dielectric material is selected from the group consisting of barium titanate, magnesium titanate, strontium titanate, zirconium titanate, lead titanate, lithium titanate, potassium titanate, bismuth titanate, calcium titanate, yttrium titanate, lithium niobate, potassium niobate, lithium tantalate, lead zirconate, barium zirconate, barium stannate and their solid solutions, and sodium tartrate.

10. The toner composition as claimed in claim 1, wherein the highly dielectric material is a titanate.

11. The toner composition as claimed in claim 1, wherein the highly dielectric material has a particle size of below 3 μm.

12. The toner composition as claimed in claim 1, wherein the highly dielectric material is a fine powder having a hydrophobic surface.

13. The toner composition as claimed in claim 6, wherein the polymerizing monomer contains 3 to 25 carbon atoms.

14. The toner composition as claimed in claim 6, wherein the polymerizing monomer is selected from the group consisting of styrene, p-chlorostyrene, p-methylstyrene, vinyl acetate, vinyl propionate, vinyl benzoate, methyl acrylate, ethyl acrylate, n-butyl acrylate, iso-butyl acrylate, dodecyl acrylate, n-octyl acrylate, methyl methacrylate, ethyl methacrylate, n-butyl methacrylate iso-butyl methacrylate, diethyleaminoethyl methacrylate, t-butylaminomethyl methacrylate, acrylonitrile, 2-vinylpyridine, 4-vinylpyridine and combinations thereof.

15. The toner composition as claimed in claim 6, further comprising 0.05 to 20 wt % of a polyfunctional monomer selected from the group consisting of divinylbenzene, ethylene glycol dimethacrylate, trimethylolpropane triacrylate, glycidyl methacrylate and glycidyl acrylate.

16. The toner composition as claimed in claim 6, wherein 0.1 to 5 wt % of the dispersion stabilizer is a water soluble compound selected from the group consisting of gelatin, starch, hydroxyethylcellulose, carboxymethylcellulose, polyvinylpyrrolidone, polyvinyl alkyl ethers and polyvinyl alcohol.

17. The toner composition as claimed in claim 6, wherein 0.1 to 5 wt % of the dispersion stabilizer is selected from the group consisting of barium sulfate, calcium sulfate, barium carbonate, calcium carbonate, magnesium carbonate and calcium phosphate.

18. The toner composition as claimed in claim 6, further comprising an effective amount of a low molecular weight olefinic polymer for preventing offset and for improving fluidity and fixability.

19. The toner composition as claimed in claim 18, wherein 1 to 20 parts by weight of the low-molecular weight olefinic polymer is selected from the group consisting of polyethylene, polypropylene, ethylene-vinyl acetate copolymer, chlorinated polyethylene wax, polyamide, polyester, polyurethane, polyvinyl butyral, butadiene rubber, phenolic resin, epoxy resin, rosin-modified resin, silicone oil, and silicone wax.

20. The process as claimed in claim 4, further comprising subjecting said highly dielectric material to surface hydrophobic treatment.

* * * * *